US005341645A

United States Patent [19]

Ansart et al.

[11] Patent Number: 5,341,645

[45] Date of Patent: Aug. 30, 1994

[54] FUEL/OXIDIZER PREMIXING COMBUSTION CHAMBER

[75] Inventors: Denis R. H. Ansart, Bois Le Roi; Michel A. A. Desaulty, Vert Saint Denis; Denis J. M. Sandelis, Nangis, all of France

[73] Assignee: Societe National d'Etude et de Construction de Moteurs d'Aviation (S.N.E.C.M.A.), Paris, France

[21] Appl. No.: 44,388

[22] Filed: Apr. 8, 1993

[30] Foreign Application Priority Data

Apr. 8, 1992 [FR] France ..... 92 04281

[51] Int. Cl.[5] ..... F02C 1/00; F02G 3/00

[52] U.S. Cl. ..... 60/737; 60/738; 60/742; 60/743; 60/746; 60/749; 60/261

[58] Field of Search ..... 60/737, 738, 742, 743, 60/746, 749, 261

[56] References Cited

U.S. PATENT DOCUMENTS

| | | | |
|---|---|---|---|
| 2,920,449 | 1/1960 | Johnson et al. | 60/737 |
| 2,931,174 | 4/1960 | Allen | 60/738 |
| 3,147,594 | 9/1964 | Hill et al. | 60/749 |
| 3,151,453 | 10/1964 | Lefebvre et al. | 60/743 |
| 3,176,465 | 4/1965 | Colley, Jr. | 60/749 |
| 3,315,468 | 4/1967 | Vdoviak | 60/749 |
| 3,504,491 | 4/1970 | Wigg | 60/749 |
| 3,800,527 | 4/1974 | Marshall | 60/749 |
| 4,203,796 | 4/1993 | Washam et al. | 60/749 |
| 4,561,257 | 12/1985 | Kwan et al. | 60/737 |
| 5,076,053 | 12/1991 | McVey et al. | 60/749 |

FOREIGN PATENT DOCUMENTS

| | | | |
|---|---|---|---|
| 0161852 | 2/1954 | Australia | 60/738 |
| 1168777 | 3/1957 | France | 60/738 |
| 709452 | 5/1954 | United Kingdom . | |

*Primary Examiner*—Richard A. Bertsch
*Assistant Examiner*—Howard R. Richman
*Attorney, Agent, or Firm*—Bacon & Thomas

[57] ABSTRACT

A fuel/oxidizer pre-mixing combustion chamber for a turbojet engine is disclosed in which the pre-mixing device is incorporated into the upstream end wall structure of the combustion chamber. The upstream end portion of the combustion chamber, which is in communication with the oxidizer, has a plurality of generally radially extending, "V"-shaped members oriented such that the vertex of the "V" shape faces in an upstream direction. These members extend generally radially between the inner and outer walls which define the boundaries of the combustion chamber. The members define upstream edges and downstream edges which are axially the upstream edges. Fuel injectors extend radially inwardly between these members and are axially positioned between the locations of the upstream and downstream edges so as to spray fuel onto the adjacent sides of each of the members. The downstream edges of the members are circumferentially spaced apart so as to define a passage which is in communication with the oxidizer source and the combustion chamber.

11 Claims, 3 Drawing Sheets

FUEL/OXIDIZER PREMIXING COMBUSTION CHAMBER

BACKGROUND OF THE INVENTION

This present invention relates to a combustion chamber for a turbojet engine, more particularly such a combustion chamber having a structure for pre-mixing the fuel and oxidizer prior to its entry into the combustion area of the combustion chamber.

It is known for gas turbine engines, particularly, aircraft turbojet engines, to have annular combustion chambers defined by radially displaced inner and outer annular walls extending symmetrically about a central longtudinal axis of the engine so as to define the annular combustion chamber between them. The upstream end of the combustion chamber is typically defined by a wall which extends generally perpendicular to the longitudinal axis between the inner and outer combustion chamber walls. Means are provided for supplying fuel to the interior of the combustion chamber, such as by fuel injection nozzles, and openings may be provided to permit the flow of oxidizer, typically air, from an oxidizer source into the combustion chamber to be mixed with the fuel.

Presently, one of the main problems of gas turbine engine design is to reduce the nitrogen-oxide emissions of the engine. It is known to pre-mix the fuel with the oxidizer before actual combustion takes place in order to reduce the nitrogen-oxide emissions.

SUMMARY OF THE INVENTION

A fuel/oxidizer pre-mixing combustion chamber for a turbojet engine is disclosed in which the pre-mixing device is incorporated into the upstream end wall structure of the combustion chamber. The upstream end portion of the combustion chamber, which is in communication with the oxidizer, has a plurality of generally radially extending, "V"-shaped members oriented such that the vertex of the "V" shape faces in an upstream direction. These members extend generally radially between the inner and outer walls which define the boundaries of the combustion chamber. The vertexes of these members define upstream edges which lie in a common plane extending generally perpendicular to a central longitudinal axis of the turbojet engine. Each member has a downstream edge, which edges also lie in a common plane extending generally perpendicular to the central axis. The downstream edges are axially spaced downstream from the plane of the upstream edges.

Fuel injectors extend radially inwardly between these members and are axially positioned between the locations of the upstream and downstream edges so as to spray fuel onto the adjacent sides of each of the members. The downstream edges of the members are circumferentially spaced apart so as to define a passage which is in communication with the oxidizer source and the combustion chamber.

Second "V"-shaped members may be associated with each fuel injector and oriented such that the vertexes of these members face in a downstream direction. The second "V"-shaped members define openings which enable the fuel to be directed through the second members onto surfaces of the first members.

Adjacent portions of the first and second members define an additional passageway therebetween which is in communication with the oxidizer and the passageway defined between the downstream edges. The portions of the members defining the sidewalls of the passageway may converge in a generally downstream direction.

The downstream sides of the first "V"-shaped members open into the combustion chamber and are subjected to the heat generated during the combustion of the gases within the chamber. Thus, as fuel is sprayed from the fuel injectors onto the upstream sides of the "V"-shaped members, it is vaporized and mixed with the oxidizer passing through the passageways prior to the entry of the mixture into the combustion area of the chamber.

The combustion chamber structure according to the present invention attains effective pre-mixing of the fuel and oxidizer within an axially limited space, thereby enabling the size and complexity of the turbojet engine structure to be reduced.

DETAILED DESCRIPTION OF THE PREFERRED EMBODIMENT

Although the combustion chamber structure will be described in conjunction with an aircraft turbojet engine, it is to be understood that the principals elucidated herein are not limited to such use, but may be incorporated into other types of gas turbine engines.

Figure 1:
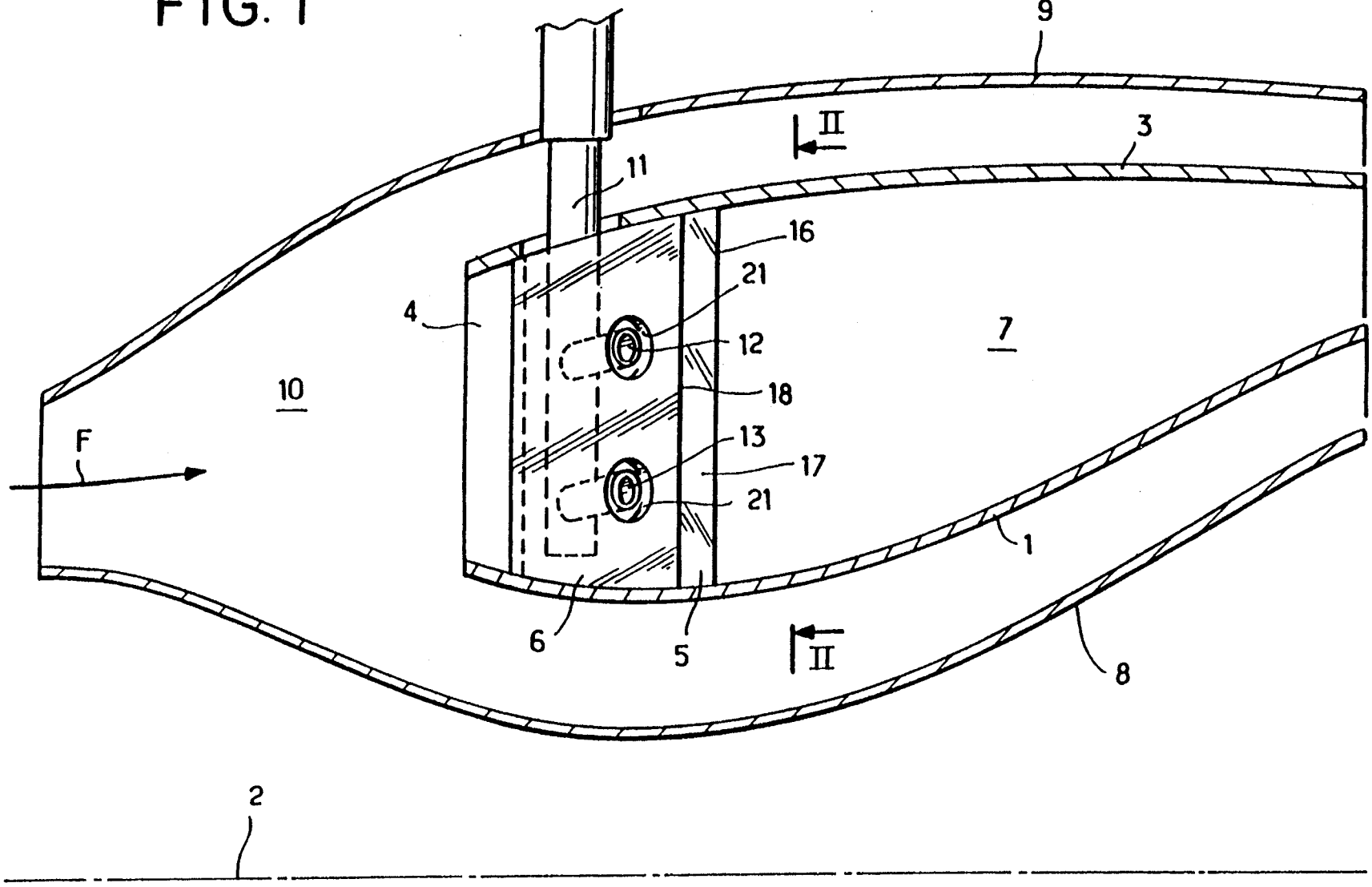
FIG. 1 is a partial, longitudinal, cross-sectional view of a combustion chamber having the construction according to the present invention.

The combustion chamber according to the present invention, as illustrated in FIG. 1, comprises an inner annular wall 1 extending about central longitudinal axis 2, an outer annular wall 3 also extending symmetrically about central axis 2 and an upstream end wall structure 4. These wall structures define the boundaries of combustion chamber 7. The upstream end wall structure 4 comprises a plurality of first members 5, a plurality of second members 6 back of which extend generally radially about central axis 2 and which are generally located in a plane extending transversely to the axis 2 between inner wall 1 and outer wall 3. The ends of members 5 and 6 may be attached to inner and outer walls 1 and 3, respectively. The engine structure may further comprise an inner casing 8, again extending symmetrically about axis 2, and an outer casing 9 which also extends around axis 2 and is radially spaced from the inner casing 8 so as to define therebetween an oxidizer space 10. The oxidizer space 10 communicates with an oxidizer source (not shown), which may comprise a turbofan or a compressor stage, so as to direct the oxidizer into the oxidizer space 10 as indicated by arrow F.

A plurality of fuel injectors 11 each define a plurality of pairs of injector nozzles 12 and 13 to supply fuel to the combustion chamber 7. The nozzles 12, which are located closest to the outer wall 3 supply fuel when the engine operates in the low-power mode of operation. Fuel injection nozzles 13, which are located nearest the inner annular wall 1, supply fuel during the full power operation of the engine. Preferably, the segments of the fuel injectors 11 which are located between the inner and outer walls 1 and 3 and upstream of the end wall structure 4 outside of the combustion chamber 7 constitute "pencil" type fuel injectors. Fuel injectors 11 may be attached to the outer casing 9 by known techniques.

Figure 2:
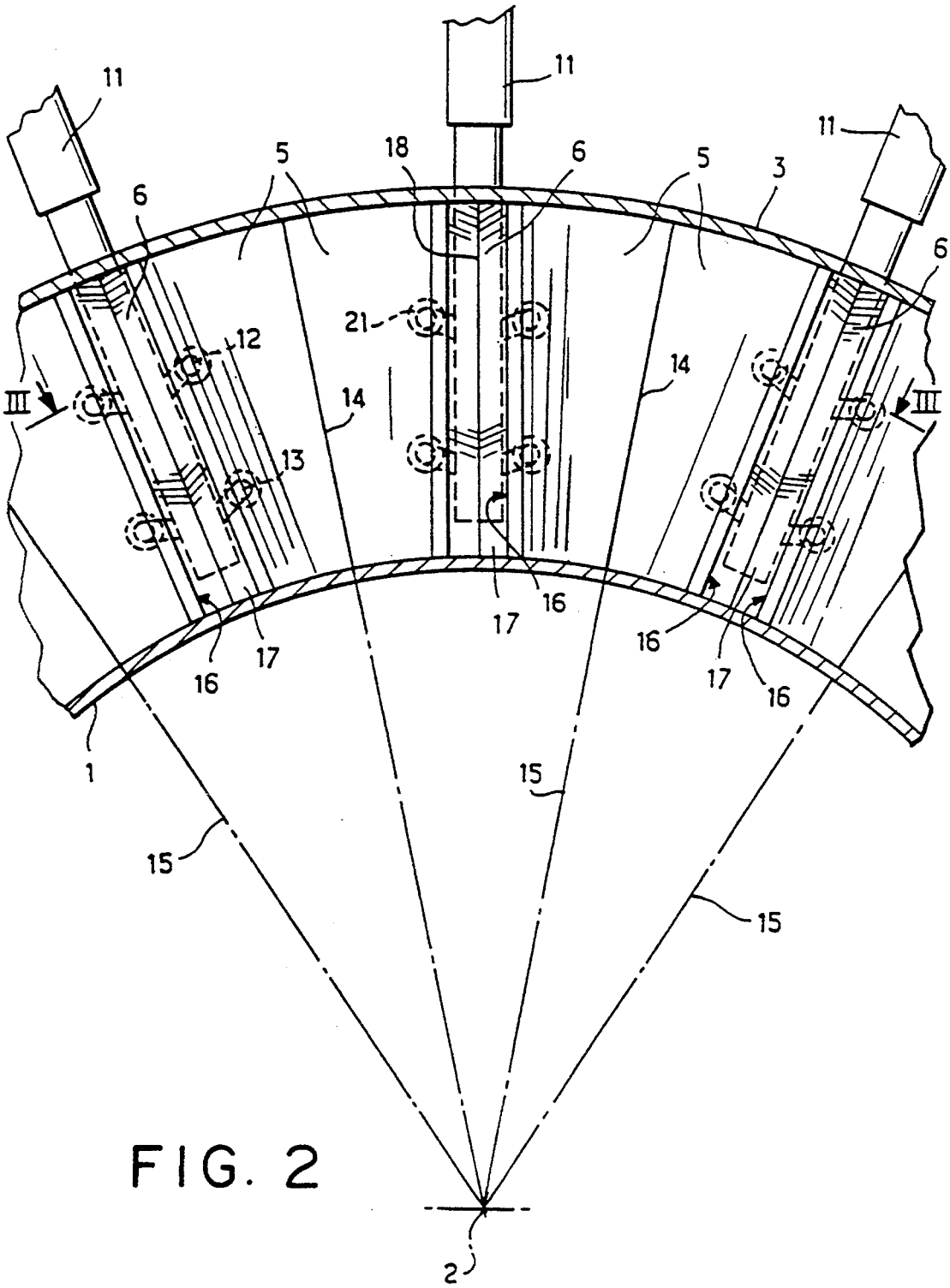
FIG. 2 is a partial, cross-sectional view taken along line II—II in FIG. 1.
Figure 3:
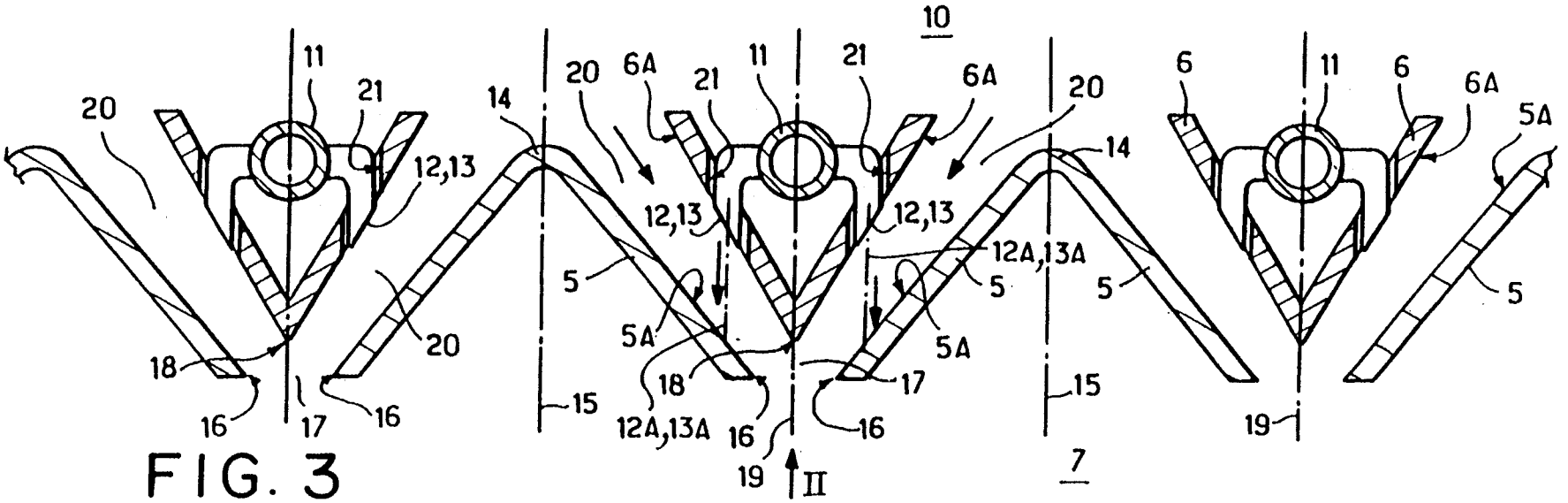
FIG. 3 is a partial, cross-sectional view taken along line III—III in FIG. 2.

As best seen in FIGS. 1–3, the first members 5 have a generally "V"-shaped cross-sectional configuration with the vertex of the "V" facing in an upstream direction and forming upstream edge 14. The first members 5 are symmetrical relative to a plane 15 which extends radially from the central axis 2 and which includes the upstream edge 14. The upstream edges 14 of the members 5 lie generally in a common transverse plane which extends substantially perpendicular to the central axis 2. Members 5 also include downstream edges 16 which are also located in a common plane extending generally perpendicular to the central axis 2, but which is axially spaced apart from the plane of the upstream edges 14. Downstream edges 16 of adjacent members 5 define therebetween a first passageway 17 which communicates with the oxidizer space 10 and the combustion chamber 7. Fuel injection nozzles 12 and 13 are located opposite external sides 5A of the members 5 such that the axes 12A and 13A of the fuel injection nozzles intersect the external sides 5A.

Fuel injectors 11 are located within second members 6, which may also have a generally "V"-shaped cross-sectional configuration, as best illustrated in FIG. 3. The vertexes 18 of the "V"-shape face in a downstream direction and lie in planes 19 which extend generally radially from the central axis 2. The vertexes 18 also lie in a transverse plane which extends substantially perpendicular to the central axis 2.

The legs of the "V" shaped members 6 are also symmetrically arranged relative to the plane 19. The fuel injectors 11, as well as the second members 6 are located substantially completely within the axial space between the upstream edges 14 and the downstream edges 16 of first members 5. Thus, external side 6A of member 6 faces a corresponding external side 5A of an adjacent member 5 such that they define opposite sides of a second passageway 20. Passageway 20 communicates with the oxidizer space 10 and the first passageway 17. The sides 6A and 5A converge in a direction toward the first passageway 17 such that the width of passageway 20 diminishes as it approaches the first passageway 17.

Second members 6 also define a plurality of openings 21 which are substantially in alignment with the fuel injection nozzles 12 and 13. Openings 21 may provide clearance between member 6 and the fuel injection nozzles 12 and 13 to provide an additional path for the flow of oxidizer from the space 10 into the passageways 20. Openings 21 are substantially coaxial with the fuel injection nozzle axes 12A and 13A.

Figure 4:
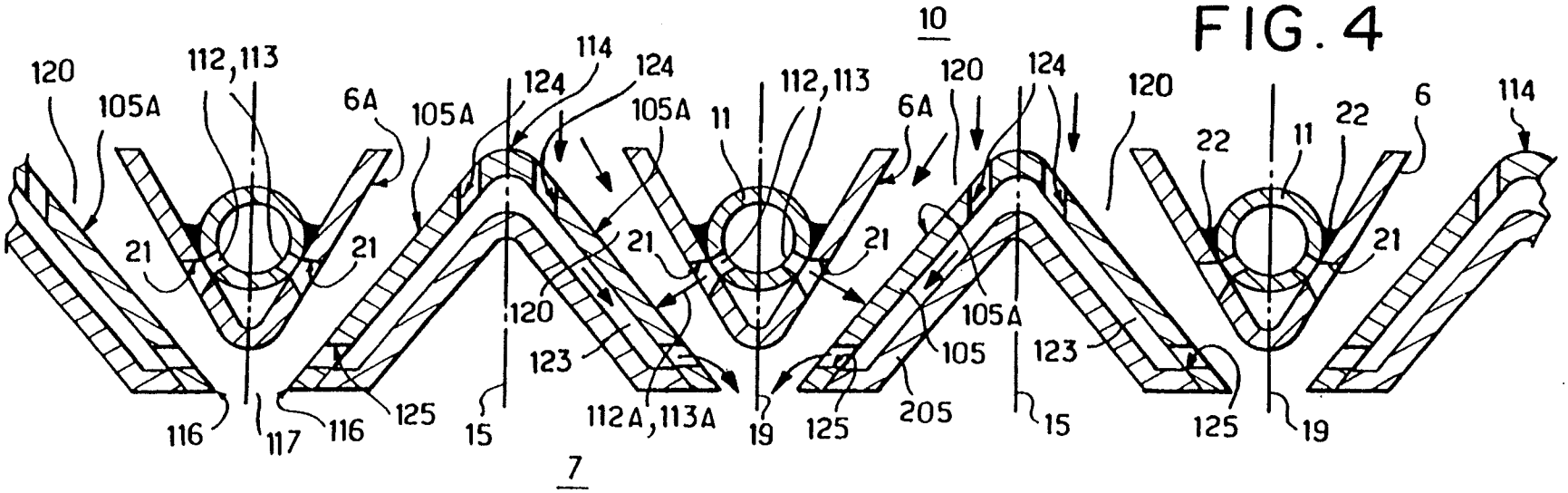
FIG. 4 is a partial, cross-sectional view similar to FIG. 3, illustrating an alternative embodiment of the structure according to the present invention

The alternative embodiment illustrated in FIG. 4 differs from that previously described by the attachment of the second members 6 directly to the fuel injectors 11 via welding, as at 22. The second members 6 may be fixedly attached to the fuel injectors 11 and need not be attached to the inner and outer annular walls 1 and 3, respectively. The structure of the first members 5 is also different in this embodiment from that previously discussed. In this embodiment, the first members comprise an upstream wall 105 and a downstream wall 205 which may be affixed together, but which define an oxidizer circulation chamber 123 therebetween. In this embodiment, the fuel injection nozzles 12 and 13 may be replaced by fuel injection holes 112 and 113 formed in the fuel injector 11 whose fuel injection axes 112A and 113A are coaxial with openings 21 and intersect the external sides 105A of upstream walls 105.

As in the previously described embodiment, the downstream edges 116 of the first members define therebetween a first passageway 117, while a second passageway 120 is defined by sides 6A and 105A which converge toward each other as the passageway approaches the first passageway 117.

Oxidizer circulation chamber 123 communicates with the passageway 120 through openings 124 and 125 defined by the upstream wall 105. Openings 124 are located near the vertex 114 of the first members, while the orifices 125 are located adjacent to the downstream edges 116. In this embodiment, as in the previous embodiment, the first members defined by walls 105 and 205 are fixedly attached, such as by welding, to the inner and outer walls 1 and 3, respectively.

In the operation of the embodiment illustrated in FIGS. 1–3, fuel from the fuel injector nozzles 12 and 13 is directed onto the sides 5A of the first members 5. Such members, which are in direct communication with the combustion chamber 7, are at an elevated temperature such that the fuel coming into contact with the sides 5A is vaporized. Oxidizer passing from the oxidizer space 10 to the combustion chamber 7 passes through passageways 20 and 17, and is thus mixed with the vaporized fuel in the absence of combustion. The pre-mixing of the fuel/oxidizer before combustion occurs in an axially restricted space, thereby minimizing the dimensions of the combustion chamber. Such compact combustion chambers are also reduced in weight, while at the same time reducing the nitrogen-oxide emissions, particularly at full power engine operation. Oxidizer entering the second members 6 may pass through openings 21 around the fuel injector nozzles 12 and 13, and will contribute to the improved vaporized fuel entrainment in the main oxidizer flow in each passageway 20. The convergent passageways 20 also enhance the entrainment effectiveness of the fuel and oxidizer.

These functions and advantages are also present in the embodiment illustrated in FIG. 4. Furthermore, by affixing the second members 6 directly onto the fuel injectors 11, the axial compactness of the system is further improved and the attachment weight is reduced. The oxidizer entering the chambers 123 enters through openings 124 and exits from the chamber through openings 125. This flow cools the first members, thereby improving their service life. Also, when exiting through the openings 125, the oxidizer will complete the fuel entrainment effect implemented by the main oxidizer flow through the second passageway 120 toward the combustion chamber 7.

The presence of first members 5, in either the structure shown in FIG. 3 or that shown in FIG. 4, is sufficient to vaporize the fuel upstream of the combustion chamber 7 and to mix it with oxidizer before combustion takes place. The presence of the second members 6 allows the passageways 20 and 120 to be given a converging shape which simultaneously improves the mixing efficiency and the entrainment of the mixture as it passes toward the combustion chamber 7. Such a convergent shape for the passageways 20 and 120 increases the mixture acceleration as it passes through these passageways toward the first passageways 17 and 117. This eliminates the dangers of self-ignition of the fuel/oxidizer mixture.

Because of their compactness, the "pencil" fuel injectors are easily and preferably integrated into the embodiments of this invention, although other types of fuel injectors may be readily used.

The foregoing description is provided for illustrative purposes only and should not be construed as in any way limiting this invention, the scope of which is defined solely by the appended claims.

I claim:

1. A fuel/oxidizer pre-mixing combustion chamber for a turbojet engine having a central longitudinal axis and an oxidizer source, the combustion chamber comprising:

a) wall means defining transverse boundaries of the combustion chamber such that the combustion chamber has an upstream end;

b) fuel/oxidizer pre-mixing means operatively associated with the upstream end of the combustion chamber comprising a plurality of first members, each first member having a substantially "V"-shaped cross-sectional configuration having external sides, an upstream edge and a downstream edge spaced from the upstream edge in an axial direction along the central axis, the downstream edges of adjacent first members defining therebetween a first passageway in communication with the oxidizer source and the combustion chamber;

c) fuel injector means positioned between adjacent first members and between the axial positions of the upstream and downstream edges of the first members, the fuel injector means having fuel injection orifices oriented to direct fuel into contact with the external sides of adjacent first members, thereby mixing the fuel and oxidizer upstream of the first passageways; and d) a plurality of second members wherein a second member is located between adjacent first members such that portions of the first and second members define opposite sides of a second passageway in communication with the oxidizer source and the first passageway and wherein each second member has a substantially "V"-shaped cross-sectional configuration and is oriented such that the vertex of the "V" faces generally in a downstream direction.

2. The fuel/oxidizer pre-mixing combustion chamber of claim 1 wherein the upstream edges of the first members generally lie in a first plane extending substantially perpendicular to the central axis and wherein the downstream edges of the first members generally lie in a second plane extending substantially perpendicular to the central axis.

3. The fuel/oxidizer pre-mixing combustion chamber of claim 2 wherein the first members are oriented such that the vertex of the "V" forms the upstream edge.

4. The fuel/oxidizer pre-mixing combustion chamber of claim 3 wherein the upstream edges extend generally radially with respect to the central axis.

5. The fuel/oxidizer pre-mixing combustion chamber of claim 1 wherein the opposite sides of the second passageway converge in a direction towards the first passageway.

6. The fuel/oxidizer pre-mixing combustion chamber of claim 1 wherein each second member is operatively associated with a fuel injector means and defines openings substantially aligned with the fuel injection orifices.

7. The fuel/oxidizer pre-mixing combustion chamber of claim 6 wherein each second member is fixedly attached to a fuel injector means.

8. The fuel/oxidizer pre-mixing combustion chamber of claim 1 wherein each "V"-shaped second member is substantially symmetrical relative to a plane extending radially from the central axis and containing the vertex of the "V"-shaped second member.

9. The fuel/oxidizer pre-mixing combustion chamber of claim 1 wherein each "V"-shaped first member is substantially symmetrical relative to a plane extending radially from the central axis and containing the upstream edge.

10. The fuel/oxidizer pre-mixing combustion chamber of claim 1 wherein each first member comprises:

a) an upstream wall;

b) a downstream wall operatively associated with the upstream wall so as to define a chamber therebetween; and c) a plurality of openings defined through the upstream wall in communication with the chamber.

11. The fuel/oxidizer pre-mixing combustion chamber of claim 1 wherein the fuel injector means comprises a plurality of pencil-type fuel injectors.

* * * * *